United States Patent [19]

Groupp

[11] 4,245,540

[45] Jan. 20, 1981

[54] SOUND SUSTAINING DEVICE FOR MUSICAL INSTRUMENTS

[76] Inventor: Barry A. Groupp, 65-24 162nd St., Flushing, Long Island, N.Y. 11365

[21] Appl. No.: 676,069

[22] Filed: Apr. 12, 1976

[51] Int. Cl.[3] ..... G10H 3/00

[52] U.S. Cl. ..... 84/1.14; 84/1.16; 84/1.24

[58] Field of Search ..... 84/1.14, 1.15, 1.16, 84/1.01, 1.24, 267

[56] References Cited

U.S. PATENT DOCUMENTS

| | | | |
|---|---|---|---|
| 3,194,870 | 7/1965 | Tondreau et al. | 84/1.16 |
| 3,357,291 | 12/1967 | Carmichael | 84/267 |
| 3,696,700 | 10/1972 | Berardi | 84/1.16 X |
| 3,742,113 | 6/1973 | Cohen | 84/1.16 X |
| 3,781,451 | 12/1973 | Nolan | 84/1.16 |
| 3,813,473 | 5/1974 | Terymenko | 84/1.16 |

FOREIGN PATENT DOCUMENTS

| | | | |
|---|---|---|---|
| 673375 | 10/1929 | France | 84/1.15 |
| 961543 | 1/1948 | France | 84/1.15 |

*Primary Examiner*—Ulysses Weldon

*Attorney, Agent, or Firm*—Lackenbach, Lilling & Siegel

[57] ABSTRACT

A device is described for musical instruments, and particularly stringed musical instruments such as a guitar, which can controllably and selectively sustain the musical sounds produced by the instrument. The device includes an electrical pick-up proximate to the strings of the guitar for generating electrical signals which correspond to the vibrations of the strings. The signals are amplified by the device and are converted in a loud speaker or other transducer mounted on the instrument and proximate to the strings into mechanical vibrations which sympathetically reinforce the initial vibrations and maintain the strings in a vibratory state and thereby sustain the sound.

18 Claims, 5 Drawing Figures

10
12
14
16
18
20
22
24
26
28
28a
32a
32b
34
36
38
40
42
44
46
48
48a
50
52
D
BATTERY
AMP
IN
OUT
SUSTAIN CONTROL
PRE-AMP. OUTPUT TO EXT. AMP.
DIRECT OUTPUT TO EXT. AMP.

16
d
24
24a
24b
24c
24d
46
N
S

SOUND SUSTAINING DEVICE FOR MUSICAL INSTRUMENTS

BACKGROUND OF THE INVENTION

The present invention generally relates to musical instruments, and more specifically to a device primarily for stringed musical instruments which can sustain the sounds originally produced on the instrument.

While the basic principle of the present invention can be applied to most musical instruments, as will become evident hereafter, the description that follows is directed primarily at stringed musical instruments. As is well known, playing a stringed instrument involves plucking the strings and setting them into vibratory motion. The vibrations of the strings disturb the surrounding air and these air disturbances are perceived by a human ear as the musical sounds which are played. Under normal circumstances, once a string has been plucked and set into motion, the amplitude of the vibrations have an initial predetermined value and thereafter the amplitude or magnitude of the vibrations continuously decrease or decay until vibrations cease totally and the string reverts to its initial stationary state. The rate of decay or the time constant involved with each of the strings is a function of numerous factors including, but not limited to, the density of the material from which the string is made, its physical dimensions, the tension of the string and the like.

Frequently, in order to produce special sound, sound effects or moods, musicians find it necessary or desirable to sustain a musical sound produced by, for example, a string of a musical instrument for a period of time which is greater than that normally associated with the time constants of the string.

With the development of electronic equipment in the mid-1930's, it was learned that by placing an electromagnetic pick-up (microphone or transducer) on a steel string guitar, the sound of that instrument could be amplified. With further development of amplification equipment in the 1940's came the emergence of a new type of guitar commonly called the "Electric" or "Solid Body" guitar. In this type of guitar the neck and body of the instrument serve only as a means of generating the original notes. The instrument basically has no acoustical qualities. The vibrating strings are sensed by the magnetic pick-ups and a musician adjusts his amplifier for volume and tonal qualities.

In about 1953, a new type of music evolved, and with it a new method of playing the electric guitar. It was in and around that time that the concept of sustaining the musical sounds of an electric guitar first developed and became widely used. The music was almost of necessity loud. By using large amplifiers and speakers, the musicians could send the notes from their speakers back to the strings of the guitar, causing a sympathetic vibration to occur which would reinforce the vibratory movements of the strings and thereby sustain the sound produced by the instrument. In effect, acoustic feedback was utilized to complete a regenerative acoustic loop. It was the exploitation of this regenerative effect that created what we recognize today as the electric guitar sound.

There has been, however, little progress since the above-described early developments. The previous or older methods, as well as those used today, which use regenerative feedback, depend on room accoustics, the type of amplifiers and speakers used and the volume of the amplified sound. In the prior art arrangements, then, the same external speakers that are used to generate the sound to the listening audience are also used in the regenerative feed-back arrangement to drive the strings. The external speakers used, which are normally spaced a considerable distance from the musicians and, therefore, from the strings of the musical instrument, are of necessity played at a very high volume or loudness. The prior art approach has not worked satisfactorily where the external speakers are driven at a moderate or low volume since the accoustic feedback is not sufficient in that instance to drive the strings and to sustain the sound. Under certain conditions, and with certain room accoustics, the loudness of the sound necessary to produce sustain on a musical instrument such as a guitar is such as to be uncomfortable to a listener.

Since "solid body" guitars basically lack acoustic qualities, the guitar could only be played and heard when connected to external speakers which are normally large and bulky. The external speakers and the amplifiers associated with most electric guitars make it difficult or at best inconvenient to easily transport the electric guitar system.

SUMMARY OF THE INVENTION

Accordingly, it is an object of the present invention to provide a sustaining device which does not have the disadvantages of the prior art devices.

It is another object of the present invention to provide a sustaining device which is simple in construction and economical to manufacture.

It is still another object of the present invention to provide a sustaining device which is at least partially mounted on and may be self-contained within the musical instrument whose sounds are to be sustained.

It is yet another object of the present invention to provide a sustaining device which does not require remote external speakers.

It is a further object of the present invention to provide a sustaining device which can sustain musical sounds substantially independently of the volume of the musical sounds produced by the musical instrument.

It is still a further object of the present invention to provide a sustaining device for sustaining the sounds of a stringed musical instrument, with the sustaining device being mounted on the musical instrument and proximate to the strings thereof to permit driving of the strings into a sustained condition substantially independently of the volume at which the musical instrument is played.

It is yet a further object of the present invention to provide a sustaining device which is light in weight and may be self-contained within the musical instrument to make the same readily portable and transportable.

It is an additional object of the present invention to provide a sustaining device which includes signal processing means for modifying the original sounds produced, including modifying the low and high frequency contents of the audio ranges and modifying the phase of the signals to be reproduced, prior to amplification and reproduction.

It is still an additional object of the present invention to provide a sustaining device which includes a transducer mounted proximate to the strings of the electric guitar or the like which is used to drive the strings of the guitar and which permits the guitar player a freedom of movement without compromising the sustaining characteristics of the guitar.

It is yet an additional object of the present invention to provide a sustaining device which includes control means for adjusting the degree of sustain and for sustaining one or more musical notes substantially indefinitely.

In order to achieve the above objects, as well as others which will become apparent hereafter, a sustaining device in accordance with the present invention for sustaining musical sounds produced by a stringed musical instrument cooperates with at least one pick-up transducer associated with the strings of the musical instrument for generating electrical signals having frequencies corresponding to the frequencies of vibrations of the strings of the musical instrument. The sustaining device comprises amplifying means connected to said pick-up transducer for amplifying said electrical signals generated by said pick-up transducer. Output transducer means is provided connected to said amplifying means for converting said amplified electrical signals into mechanical vibrations and for imparting movements to said strings to correspond to the amplified electrical signals. An output transducer means is mounted on said stringed instrument and arranged proximate to the strings of the musical instrument. Said amplifying means, said strings, said pick-up transducer, and said output transducer means together form a regenerative system for sustaining a musical sound substantially independently of the volume of the musical sounds produced by the stringed musical instrument.

In accordance with one presently preferred embodiment, wherein the sustaining device is incorporated in a guitar, an audio amplifier is connected to electromagnetic pick-ups for amplifying the electrical signals generated in the pick-ups due to the vibratory movements of the strings. The output of the amplifier is fed to a loudspeaker which is disposed in a cavity or cut-out portion of the guitar just beneath the strings. The loudspeaker is positioned in such a way that the air movements caused by the cone of the speaker are directed at the strings, such air movements constituting mechanical vibrations which reinforce the initial vibratory movements of the strings. The speaker is advantageously resiliently mounted on the guitar and is at least partially shielded with a suitable magnetic shielding material to minimize direct coupling between the loudspeaker and the electromagnetic pick-ups. In this manner, the regenerative loop is through the strings and can be controlled by controlling the level of the signals which drive the loudspeaker. The distance of the speaker from the strings may be on the order of magnitude of the thickness of the body of the guitar. By mounting the speaker or string driving mechanism directly on the guitar and in close proximity to the strings, the level or degree of sustain can be accurately controlled and any desired sustain is possible without excessively increasing the level of the audio sounds as heretofore required.

BRIEF DESCRIPTION OF THE DRAWINGS

Further advantages of the invention will become apparent from a reading of the following specification describing illustrative embodiments of the invention. The specification is to be taken with the accompanying drawings in which.

DESCRIPTION OF THE PREFERRED EMBODIMENTS

Figure 1:
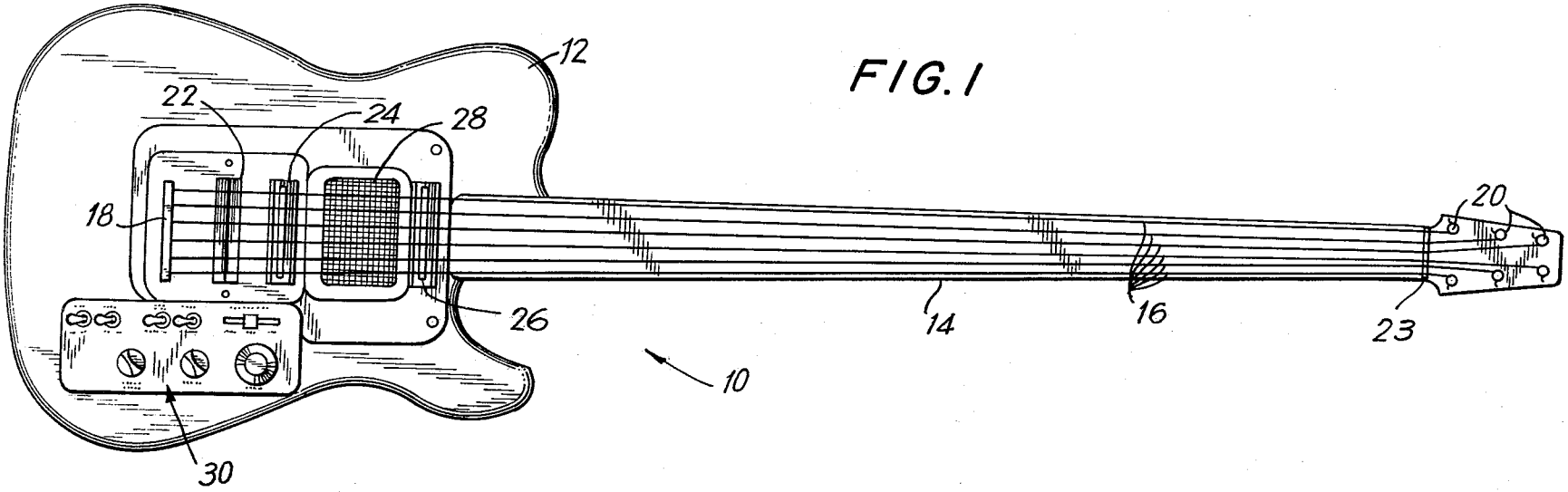
FIG. 1 is a top plan view of an electric or "solid body" guitar incorporating the sustaining device in accordance with the present invention.
Figure 2:
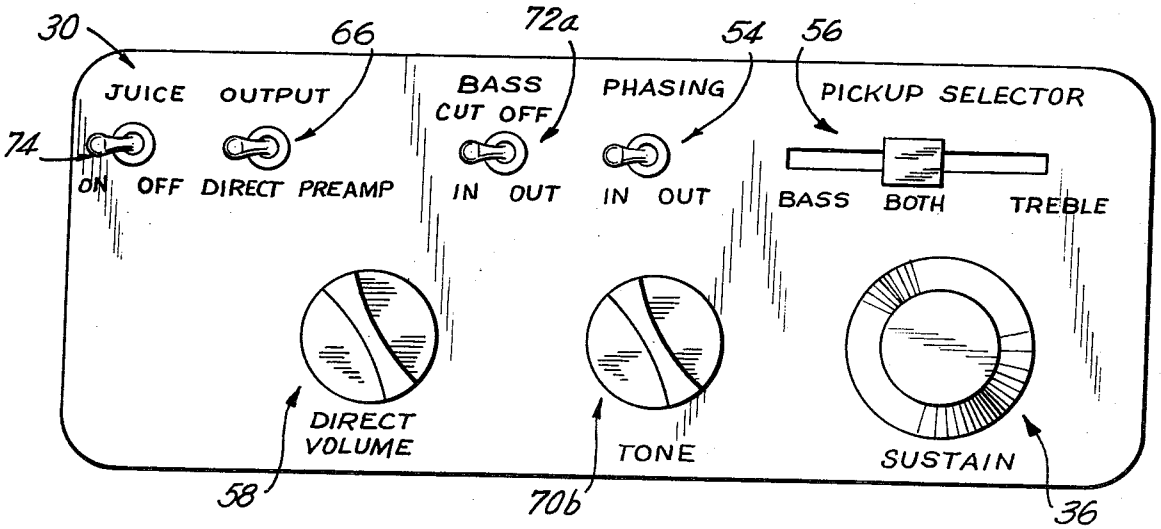
FIG. 2 is an enlarged top plan view of a control panel of the sustaining device shown in FIG. 1, showing the various controls and adjustments which can be used to modify the sounds or musical effects obtainable with the sustaining device.

Referring now specifically to FIGS. 1 and 2, wherein the identical or similar parts are designated by the same reference numerals throughout, an electric guitar 10 is shown which is of the type commonly known as a "solid body" guitar. Such a guitar has little acoustical qualities and relies substantially entirely upon an electronic pick-up and reproduction system which monitors the vibrations of the strings and converts the same into electrical signals which are amplified and used to drive external speakers. The prior art electrical guitars, therefore, could not properly be played without the associated electrical components, and namely the external amplifiers and speakers.

The electrical guitar 10 has a guitar body 12 which, as suggested above, is frequently made out of a solid material such as wood and does not have the resonant or acoustical qualities of conventional guitars. A finger board 14 extends from the guitar body 12 and a plurality of strings 16 are spaced from each other along the finger board 14. The steel strings 16 are in a state of tension, being anchored at an anchoring or holding member 18 at one end and tensioned at the other end by a series of tuning pegs 20.

Figure 3:
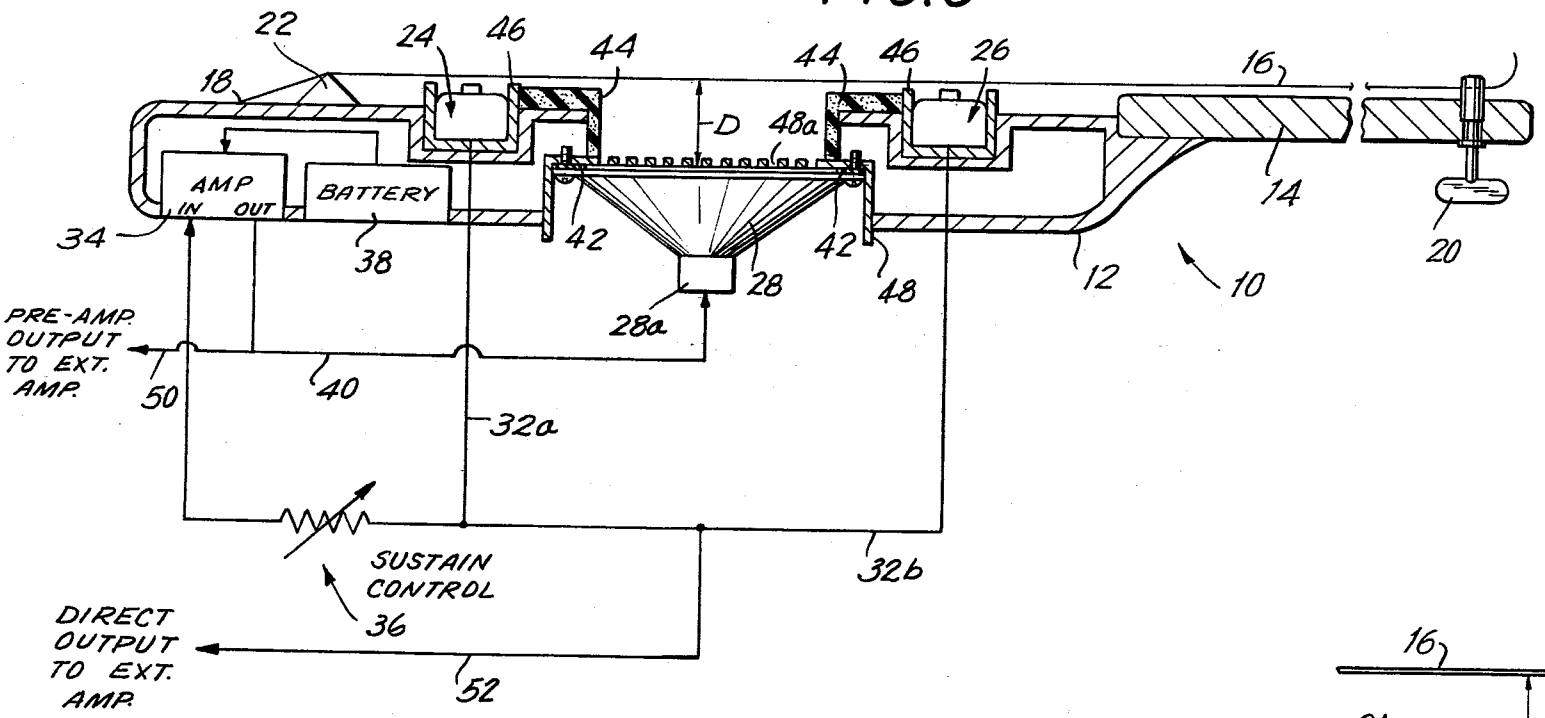
FIG. 3 is a fragmented cross-sectional view of the guitar shown in FIG. 1, and showing diagrammatically one presently preferred embodiment of the sustaining device of the present invention.

In order to elevate the strings above the guitar body 12, conventional bridges 22 and 23 are used which also space the strings from a pair of spaced electromagnetic pick-ups 24 and 26, as best shown in FIG. 3. The electromagnetic pick-ups 24 and 26 may be conventional and will be discussed more fully hereafter in connection with FIG. 4.

The sustaining device in accordance with the present invention, to be more fully described hereafter in connection with FIGS. 3 and 5, includes a loudspeaker 28 which is shown disposed in a recess or cavity formed in the guitar body 12 and directly below the strings 16. The loudspeaker 28 is positioned proximate to the strings and is oriented to direct the sound which emanates therefrom in or towards the direction of the strings so as to be capable of sympathetically driving the strings in a manner which will be more fully described hereafter.

The sustaining device of the present invention also includes a control panel 30, best shown in FIG. 2, which includes various controls, to be described below, for modifying the electrical characteristics of the sustaining device and, therefore, also of the audio out-puts which are produced by the guitar 10.

Referring to FIG. 3, there is shown the general arrangement of components in a solid body guitar which has been modified to incorporate the sustaining device of the present invention. The circuitry shown is diagrammatic and presents a basic arrangement of the sustaining device. A more versatile embodiment of the sustaining device having more controls and features will be described in connection with FIG. 5.

Referring to FIG. 3, the electromagnetic pick-ups 24 and 26 are shown mounted on the guitar and spaced from each other along the general direction of the strings 16. While two pick-ups 24, 26 are shown, it will become evident from the description that follows that one, two or more pick-ups may be used. Electric guitars are conventionally supplied with pick-ups of the type which may be used in connection with the sustaining device of the present invention. When the basic guitar has been provided with pickups, then these need not be provided since the pick-ups provided with the guitar can be used. However, where a guitar or other stringed instrument is not initially provided with pick-ups, then such pick-ups must be provided and generally arranged or positioned to pick-up the mechanical vibrations of the strings and convert the same into corresponding electrical signals. The use of pick-up transducers, such as electromagnetic pick-ups, is well known in the art, as is their selection and positioning or arrangement with reference to the strings.

Figure 4:
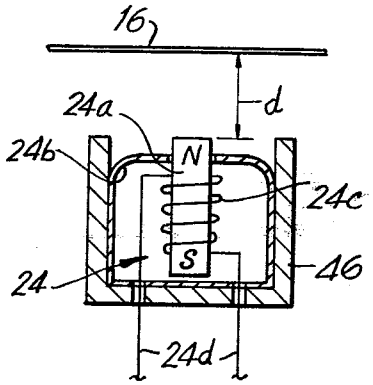
FIG. 4 is an enlarged cross-sectional view of an electromagnetic pick-up shown in FIG. 3.

Referring to FIG. 4, there is shown one typical pick-up transducer in the nature of an electromagnetic pick-up 24. The pick-up 24 generally comprises a permanent magnet 24*a* substantially enclosed within a housing 24*b* and having at least a portion thereof extending beyond the housing. A coil 24*c* is wound about the magnet 24*a* and has a pair of output terminals 24*d*. The exposed end of the magnet 24*a* is spaced a distance "d" from the steel strings 16. The permanent magnet establishes a magnetic field in the region of the steel strings. The vibrations of the steel strings 16 bring the strings closer and further away from the permanent magnet to modify the magnetic field. The changes in the magnetic field induce electrical signals in the coil 24*c* which are made available at the output terminals 24*d*.

While electromagnetic pick-ups are the conventional pick-up transducers used on electric guitars, the present invention also contemplates the use of other types of pick-up transducers. Almost any type of pick-up transducer may be utilized which monitors the vibrations of the strings, in the case of stringed instruments, and converts those vibrations to electrical signals to correspond to the vibrations. By way of example only, the pick-up transducer may be electromagnetic, electrostatic, piezoelectric, electromechanical, proximity or capacity sensitive, velocity sensitive, or any other transducer which converts physical movements to electrical energy. Photoelectric arrangements utilizing a source of light and a photocell or phototransistor may be used. It is also possible to use magneto-restrictive materials which exhibit a relationship between the physical length or dimensions thereof and the electrical potentials which they produce. For example, a nickel bar or other similar material may be used for the bridge 22, the vibrations of the strings generating electrical potentials which can be amplified. In effect, almost any material which converts physical movements to electrical signals may be used, such as rochelle salts, and materials used in contact, ceramic, ribbon, and carbon microphones. As suggested above, when a musical instrument is not initially provided with a pick-up transducer, any one of the above-described transducers may be utilized. However, when the instrument is provided with pick-ups of any type, these may be used in conjunction with the sustaining device of the present invention.

The specific positions of the pick-up transducers along the length directions of the strings 16 is not critical. In the embodiment shown in FIGS. 1 and 2, the pick-up 24 is positioned near the bridge 22 while the pick-up 26 is positioned near the fingerboard 14. As will become evident from the description that follows, either one of these two pick-ups can be used individually. Additionally, the pick-ups 24 and 26 can be spaced closer together or further apart, limited only by the dimensions of the guitar body 12 and the size and position of the speaker 28. However, it has been found that the positions of the pick-ups along the length of the strings influence the frequency content of the picked-up signals. For example, the closer the pick-up is to the bridge 22, the more harmonics that will be picked up by the pick-up 24. On the other hand, the pick-up 26, being spaced further away from the bridge 22, picks up predominantly the fundamental and, therefore, lower frequencies in the audio range.

The pick-ups 24 and 26 are connected by means of leads 32*a* and 32*b* to the input terminal of an amplifier 34 through a sustain control 36. The sustain control may comprise an adjustable potentiometer which can be used to modify or adjust the level of the signals which are fed to the amplifier 34.

The amplifier 34 is energized by a battery 38 which is housed within the guitar body 12. An external AC power supply may be used in lieu of or in addition to the battery 38 to power the amplifier 34. An on-off power switch commonly denominated as a "juice" switch in the music trade, is shown in FIG. 2 but not in FIG. 3. By using an internal battery to drive an advantageously low drain amplifier 34, a guitar which incorporates the sustaining device of the present invention is completely portable and may be played anywhere without the usual bulky and heavy auxilliary equipment.

The amplifier 34 may be a relatively low power output audio amplifier. It has been found that a three watt audio amplifier is satisfactory for the purpose to be described. One example of an amplifier which may be used is the Universal Type three watt audio amplifier manufactured by Midland Electronics. Another amplifier which is suitable for this purpose is a three watt solid state push-pull audio amplifier No. AA 900 manufactured by Philmore Manufacturing Co., Inc. While the amplifier 34 should have enough power output to drive the string 16, as to be described, and to permit listening of the electric guitar 10, it need not provide the very large power inputs that are typical of external amplifiers used to drive the external speakers commonly used with electric guitars. To drive external speakers, the outputs of the pick-ups 24, 26 can be connected to the inputs of external amplifiers as was the practice heretofore. Alternately, the output of the amplifier 34 can be fed to the external amplifiers and constitutes a pre-amplified output. As to be described more fully to FIG. 5, the direct outputs from the pick-ups and the pre-amplified output from the amplifier 34 can be materially different depending on whether the amplifier 34 is operating linearly or is in saturation.

The amplifier 34 output is connected by means of a lead or electrical conductor 40 to the loudspeaker 28. The loudspeaker 28 is thereby driven in a conventional manner, the electrical signals causing the loudspeaker 28 cone to vibrate and produce air movements which manifest themselves in audio sounds.

The guitar body 12 is provided with a suitable opening for receiving the loudspeaker 28 which may be mounted on the guitar body 12 in any conventional manner. For example, the loudspeaker 28 may be mounted by means of screws as shown in FIG. 3 with rubber grommets 42 being interposed between the loudspeaker 28 frame and the guitar body 12. Rubber, foam or any other resilient material may be used to acoustically decouple the loudspeaker 28 from the guitar body 12 for reasons to be described. Additional acoustic shielding in the nature of foam 44 may be used to further acoustically decouple the loudspeaker 28 from the guitar body 12 and the pick-ups 24 and 26.

The loudspeaker 28 serves an an output transducer means for converting the amplified electrical signals into mechanical vibrations and for imparting movements to the strings 16 to correspond to the magnified electrical signals as to be described below. While the output transducer has been described as being a loudspeaker, it will become evident to those skilled in the art that any output transducer which is capable of converting electrical signals into mechanical vibrations which may be coupled to the strings 16 may be used. For this purpose, most of the transducers described with respect to the pick-up transducer could also be used for the output transducer. Thus, if a nickel bar or other magneto-restrictive material were used, a coil could be wound around the nickel bar. When the amplified signals are applied to the coil, the nickel bar instantaneously changes dimensions to correspond to the electrical signals. The nickel bar could be used, for example, in place of the bridge 22 so that the nickel bar is in contact with the strings 16 and the instantaneous changes in dimensions of the nickel bar are equivalent to vibrations which are coupled to the strings 16. Other output transducer arrangements which can couple vibrations to the strings 16 in accordance with the amplified signals will become readily evident to those skilled in the art.

When the output transducer is in the nature of a loudspeaker or other electromagnetic device, electromagnetic fields are established in the vicinity of the electromagnet **28*a* in addition to the generation of vibrations. While the grommets 42 and the acoustic shield 44 are intended to acoustically decouple the loudspeaker 28 from the pick-ups 24 and 26, there is also advantageously provided magnetic shields 46 which substantially surround or enclose the electromagnetic pick-ups 24 and 26. Such magnetic shields 46 assist in electrically decoupling the loudspeaker 28 from the electromagnetic pick-ups 24, 26 so that direct acoustic and electrical coupling between the loudspeaker 28 and the magnetic pick-ups 24, 26 are minimized. To still further reduce the amount of electrical or magnetic coupling between the loudspeaker 28 and the pick-ups 24, 26, there is advantageously provided a further magnetic shield which substantially, if not fully, encloses or surrounds the loudspeaker 28 and is interposed between the pick-ups 24, 26 and the loudspeaker 28. The magnetic shields 46 and 48 may be made from any highly permeable magnetic or ferrous material, such as tin or Mumetal. Where the magnetic shield 48 substantially encloses the loudspeaker 28, and particularly the cone area through which the sound emanates, the magnetic shield 48 is advantageously provided with an array of holes or apertures 48*a* to form a grill or mesh through which the air movements may propagate in the direction of the strings 16**.

An important feature of the present invention is that the output transducer, or the loudspeaker 28 in the embodiment being described, is mounted on the instrument and arranged proximate to the strings 16 of the guitar 10. In FIG. 3, the loudspeaker 28 is shown spaced from the strings 16 a distance "D". While the distance "D" is not critical, it is substantially smaller than the distances which heretofore existed between the strings of an electrical guitar and the external speakers. Where the guitar 10 has a thickness of the body 12 equal to a predetermined value, the spacing "D" between the loudspeaker 28 and the strings 16 is advantageously on the order of magnitude of the predetermined thickness of the guitar body 12.

Where the output transducer such as the loudspeaker 28 is mounted below the strings 16, the distance "D" is typically on the order of magnitude of the thickness of the guitar body 12. However, the output transducer need not be located beneath the strings as shown in the Figures, but may be disposed anywhere on the musical instrument. Thus, for example, the output transducer may be positioned on the guitar body 12 beyond the anchor or holding member 18 for the strings 16, or on either side of the strings. With the latter arrangement, however, there is advantageously provided air ducts which extend between the output transducer and the strings to couple the air movements and vibrations of the output transducer to the strings. With such an arrangement, the distance which must be primarily considered is the distance between the output of the air duct and the strings 16, which distance could be approximately equal to the distance "D" above described.

The output of the amplifier 34 may, as suggested above, constitute a preamp output to an external amplifier. The lead or conductor 50 may be connected to an output jack or to an output selector switch as described in connection with FIG. 5. Similarly, the lead or conductor 52 is connected to the pick-ups 24, 26 directly and may similarly be connected to an output jack or to an output selector switch.

Figure 5:
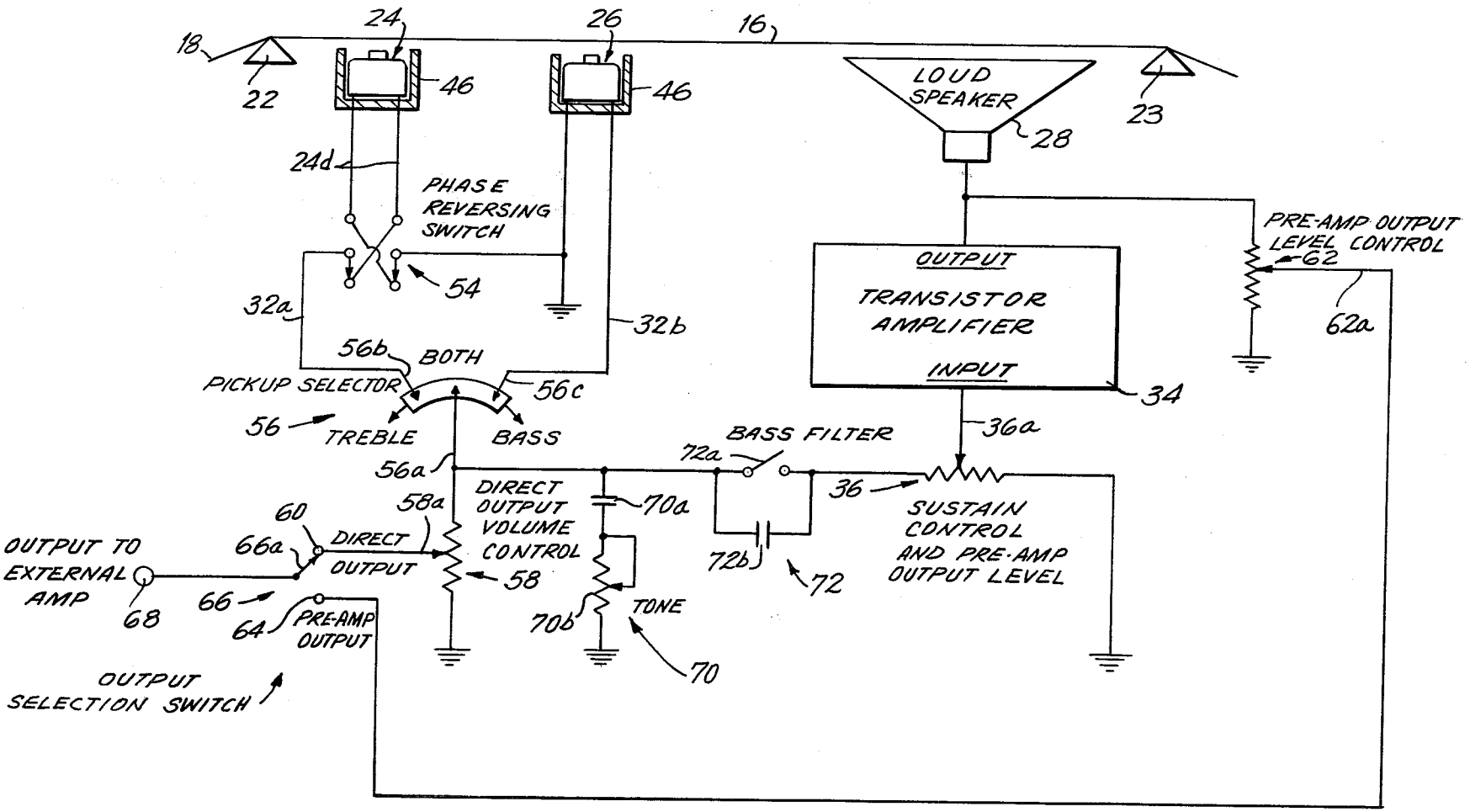
FIG. 5 is a diagrammatic and electrical schematic representation of another presently preferred embodiment of the sustaining device of the present invention, showing additional and optional features with which the sustaining device may be provided.

Referring to FIG. 5, there is shown a further embodiment of the sustaining device in accordance with the present invention, which includes more features and is more versatile than the device shown in FIG. 3. There is provided, for example, a phase reversing switch 54 connected by way of leads **24*d* to the treble pickup 24. A pick-up selector switch 56 is provided which has a movable or sliding contact 56*a* and fixed contact 56*b* and 56*c*. The phase or reversing switch 54 is connected to the stationary contacts 56*b* by means of lead 32*a* while the fixed contact 56*c* is connected to the pick-up 26 by means of lead 32*b*. The pick-up selector switch 56 advantageously has three positions so that the individual or the combined outputs of the pick-ups 24, 26 may be selected. Only one phase reversing switch 54 is shown to permit changes in relative phase of the signals generated by the pick-ups 24,26. However, a second phasing switch for pick-up 26** may be provided.

The moveable contact **56*a* of the pick-up selector switch 56 is connected to a direct output volume control 58 which may be in the nature of a potentiometer having a sliding contact 58*a*. The sliding contact 58*a* is connected to a fixed terminal 60 of an output selector switch 66. The output of the amplifier 34 is connected to a pre-amp output level control 62** which may be in the nature of a potentiometer having a sliding contact 62*a*. The sliding contact 62*a* is connected to another fixed contact 64 of the output selector switch 66. The moveable contact 66*a* of the output selector switch 66 is connected to an output terminal jack 68 suitable for use in conjunction with an external amplifier. With this arrangement, the musician may select the output which he desires to have amplified by the external amplifiers and reproduced by the external speakers.

When the amplifier 34 operates in the linear range, such as when the signals at the input to the amplifier 34 are relatively small, the outputs at the terminals 60 and 64 are substantially equivalent except for magnitude. However, when the input signals to the amplifier 34 exceed a predetermined value, the output signals become clipped or otherwise distorted due to the saturation of the amplifier. The signals which then appear at the pre-amp output terminal 64 are substantially different in harmonic overtone content than the original signals which are generated by the pick-ups 24, 26 and available at the direct output terminal 60. In some instances, musicians may prefer to use the somewhat distorted output signals appearing at the terminal 64 as opposed to the direct output signals appearing at the terminal 60 in order to obtain special sounds or effects.

The level of the signals at the direct output terminal 60 are initially adjusted by means of the direct output volume control 58 while the level of the signals at the pre-amp output terminal 64 are adjusted by means of the pre-amp output level control 62.

The level of the signals appearing at the input to the amplifier 34 are primarily determined by the sustain control 36 which is in the nature of a potentiometer, with a sliding terminal 36*a* thereof connected to the input terminal of the amplifier 34. With this arrangement, and with the gain of the amplifier 34 substantially fixed, the level of the signals at the output of the amplifier 34 are primarily determined by the levels of the signals at the input thereto. The input levels to the amplifier 34 are, of course, determined by the activity of the steel strings 16 as well as the efficiency of the pick-ups 24, 26. Additionally, slight changes in level may result between the different positions of the pick-up selector switch 56. The levels of the signals at the output terminal of the amplifier 34 can be effectively controlled by adjusting the sustain control or potentiometer 36. The sustain control 36 can be effectively adjusted to provide relatively low level or high level signals at the output of the amplifier 34.

The greater the electrical input levels to the loudspeaker 28, the greater the vibratory movements of the loudspeaker cone and the greater the air movements created by the loudspeaker. The louder the audio from the loudspeaker 28 or the greater the air movements which propagate therefrom, the more the loudspeaker 28 drives the steel strings 16 into sympathetic vibratory modes.

An optional tone control 70 is provided which includes a capacitor 70*a* and potentiometer 70*b* connected as shown in a conventional manner. Additionally, a base filter generally designated by the reference numeral 72 may be provided which includes a switch 72*a* connected in parallel with the capacitor 72*b* as shown in FIG. 5. Both the tone control 70 and the base filter 72 are connected between the pick-ups and the input to the amplifier 34 so that the frequency content of the input signals can be modified prior to amplification.

It should be evident from the above description that the basic principle of operation involves provision of a regenerative acoustic feedback loop which at least comprises the amplifier 34, the strings 16, the pick-up transducers 24, 26 and the output transducer or loudspeaker 28. However, to control the degree of regeneration and to prevent spurious oscillations, it is important that the direct coupling between the output transducer or loudspeaker 28 and the pick-up transducers 24, 26 be minimized. It is for this reason that the acoustic shielding means 42, 44 and the magnetic shielding means 46,48 are provided. Under ideal conditions, there is litte or no coupling between the loudspeaker 28 and the pick-ups 24, 26 and all coupling between these transducers takes place only through the strings 16 themselves.

As described above, the time constants of the steel strings 16 will have a tendency to cause the vibrations thereof to decay with time. Driving the strings with relatively low audio levels at least partially compensates for the tendencies of the strings to decay and causes the decay to be more gradual, thereby increasing the sustain of the notes. Driving the strings harder with greater audio outputs may fully or over-compensate for the tendency of the steel string vibrations to decay. Accordingly, adjustment of the sustain control potentiometer 36 can be used to adjust the degree of sustain or the length of time during which a note is played. Increasing the signals excessively at the input of the amplifier 34 may over compensate the tendency of the strings 16 to come to rest and the strings will continue to vibrate more vigorously with time to thereby cause an increase rather than a decrease in volume at the output of the guitar with time. This can also be used by a musician to produce special musical effects.

To operate the guitar 10, the power or "juice" switch 74 is moved to the "on" position. The other various controls, switches or adjustments shown on the control panel 30 in FIG. 2 are then moved to the required positions to provide a desired musical effect. Depending on how long the notes are to be sustained, the sustain control 36 is adjusted to increase or to decrease the sustain time. The guitar 10 can be played at this point. It may be pointed out that the various controls discussed above and shown in FIG. 2 may be changed during play of the guitar and, in fact, even while a note or series of notes are being sustained. For example, a noticeable difference in sound quality results when the phase reversing switch 54 is switched between one and the other positions while one or more notes are being sustained by the device of the present invention. The same is true when, for example, the base filter switch 72*a* is moved between the on and off positions.

Due to the gain of the amplifier 34, the signals at the output thereof are substantially greater than the signals at the input. The gain of the audio amplifiers of the type which may be used and which are described above is typically such that a 10 mV. input provide a 2 watt output. For this reason, the pre-amp output level control 62 is advantageously adjusted so that the levels at the output terminals 60 and 64 are substantially on the same order of magnitude. In this way, switching of the output selector switch 66 does not result in substantial changes in levels at the outputs of the external speakers. The pre-amp output level control 62 may be pre-adjusted when the sustain device is introduced into the guitar 10 and need not be adjusted during normal use. For this reason, the pre-amp output level control 62 is not shown to be accessible on the control panel 30 and comprises a potentiometer which is mounted internally of the guitar.

While the sustaining device of the present invention has been described in conjunction with a guitar 10, it should be clear, as suggested above, that the sustaining device can be used on any stringed instrument including, but not limited to, pianos, violins, banjos and the like. It is also possible to use the acoustic feedback principle of the present invention to sustain the musical sound for instruments other than stringed instrument. In each case, it is necessary to use a pick-up transducer, such as a microphone, which produces electrical signals corresponding to the audio sounds which are generated by the instrument. The electrical signals are then amplified, as described above, and a suitable transducer means must be utilized to operate the musical instrument in a manner which would sustain the sounds. Each type of instrument may require a different output transducer which may be as simple as a loudspeaker or may be substantially more complicated. The selection of pick-up and output transducers for each instrument to be sustained would be well within the skill of the person skilled in the art.

The above-described embodiments have been described as fully housing the sustaining device of the present invention. Thus, the pick-ups 24, 26, the loudspeaker 28, the amplifier 34, the battery 38, and the associated circuitry have all been described as being mounted or enclosed within the guitar body 12. However, as should be evident from the above, only the input and output transducers need be mounted on the guitar body 12. The balance of the components forming part of the sustaining device described above can be contained in a separate box or housing. This "kit" form or arrangement is particularly suitable for providing instruments with sustain capabilities without materially modifying the bodies of such instruments. When used with a conventional electric guitar, for example, a suitable output transducer may be substituted for the bridge 22 for mechanically driving the strings 16. The sustaining device "box" is then connected to the electrical pick-up and to the modified bridge output transducer. The various controls shown on the panel 30 may be provided on the "remote" box together with the circuitry described above. In each case, the operation of the sustaining device is the same as described above.

It is to be understood that the foregoing description of the various embodiments illustrated herein is exemplary and various modifications to the embodiments herein may be made without departing from the spirit and scope of the invention.

What is claimed is:

1. A sustaining device for sustaining musical sounds produced by a stringed musical instrument which includes at least one electromagnetic pick-up associated with the strings of the musical instrument for generating electrical signals having frequencies corresponding to the frequencies of vibrations of the strings of the musical instrument, the sustaining device comprising amplifying means connected to said electromagnetic pick-up for amplifying said electrical signals generated by said electromagnetic pick-up; and a loudspeaker serving as an output transducer connected to said amplifying means for converting said amplified electrical signals into mechanical vibrations and for imparting movements to said strings to correspond to the magnified electrical signals, said loudspeaker being resiliently mounted on the musical instrument to minimize direct acoustic coupling between said loudspeaker and said electromagnetic pick-up and arranged proximate to the strings of the musical instrument, said amplifying means, said strings, said electromagnetic pick-up and said loudspeaker together forming a self-contained regenerative system for sustaining a musical sound substantially independently of the volume of the musical sounds produced by the stringed musical instrument; acoustic shielding means provided for acoustically shielding said loudspeaker from said electromagnetic pick-up to minimize direct acoustic coupling between the same; and electromagnetic shielding means for electromagnetically shielding said loudspeaker from said electromagnetic pick-up to minimize direct electromagnetic coupling between the same, whereby mechanical, electromagnetic and acoustical feedback takes place primarily only through the vibrating strings of the instrument to thereby provide controlled sustain of the musical notes.

2. A sustaining device as defined in claim 1, wherein a plurality of electromagnetic pick-ups are provided along the length of the strings, each of said electromagnetic pick-ups being connected to said amplifying means, whereby said amplifying means amplifies the electrical signals generated by each of said plurality of electromagnetic pick-ups.

3. A sustaining device as defined in claim 2, wherein one of said plurality of electromagnetic pick-ups is arranged along said strings to pick up predominantly fundamental frequencies, and another of said plurality of electromagnetic pick-ups is arranged to pick up the fundamental and additional harmonic frequencies.

4. A sustaining device as defined in claim 2, wherein each of said plurality of electromagnetic pick-ups is disposed along the strings to pick up signals containing the fundamental and different harmonic frequencies within the audio range, and further comprising electromagnetic pick-up selector means for selectively connecting said amplifying means to one or more of said electromagnetic pick-ups, whereby sustain can be established of a fundamental or one or more harmonic frequencies by amplifying only the signals generated by the selected electromagnetic pick-ups.

5. A sustaining device as defined in claim 4, wherein said electromagnetic pick-up selector means comprises a multi-position switch, each position of said switch representing a different connection of said amplifying means to one or more of said electromagnetic pick-ups.

6. A sustaining device as defined in claim 1, wherein said electromagnetic pick-up generates electrical signals having a predetermined phase; and further comprising phase control means interposed between said pick-up transducer and said amplifying means for changing the phase of said electrical signals prior to amplification.

7. A sustaining device as defined in claim 6, wherein said phase control means comprises a phase reversing switch.

8. A sustaining device as defined in claim 1, further comprising a tone control interposed between said at least one electromagnetic pick-up and said amplifying means for adjusting the high frequency content of said electrical signals to be amplified.

9. A sustaining device as defined in claim 1, further comprising a bass control interposed between said at least one electromagnetic pick-up and said amplifying means for adjusting the low frequency content of said electrical signals to be amplified.

10. A sustaining device as defined in claim 1, further comprising a sustain control interposed between said at least one electromagnetic pick-up and said amplifying means for adjusting the level of said electrical signals to be amplified, whereby the magnitude of said mechanical vibrations produced by said loudspeaker and the degree of sustain can be adjusted by adjustment of said sustain control and thereby said signals to be amplified and amplified signals which are converted into said mechanical vibrations by said loudspeaker.

11. A sustaining device as defined in claim 1, whereby said amplifying means comprises an audio amplifier having an amplifier output terminal connected to said loudspeaker.

12. A sustaining device as defined in claim 11, further comprising an external output terminal adapted to be connected to an external amplifier; and output switch means for selectively connecting said external output terminal to said loudspeaker or to said amplifier output terminal to respectively provide a direct or pre-amplified output to the external amplifier.

13. A sustaining device as defined in claim 12, further comprising a pre-amp level control means connected between said output switch means and said amplifier output terminal for adjusting the level of pre-amp output at said external output terminal.

14. A sustaining device as defined in claim 1, wherein said acoustic shielding means comprises a resilient material.

15. A sustaining device as defined in claim 1, wherein said electromagnetic shielding material comprises a magnetic material which is interposed between said electromagnetic pick-ups and said loudspeaker.

16. A sustaining device as defined in claim 15, wherein said magnetic shielding material at least partially surrounds or encloses at least one of said electromagnetic pick-ups and said loudspeaker.

17. A sustaining device as defined in claim 16, wherein said shielding material comprises a sheet of magnetic material which at least partially surrounds said loudspeaker and is provided with a series of openings on the surface portion thereof facing the instrument strings to permit the vibratory air movements generated by the loudspeaker to propagate through said openings to drive or cause vibrations of the strings.

18. A sustaining device as defined in claim 1, wherein the instrument is a guitar having a body of a predetermined thickness, and the spacing between said loudspeaker and the strings is on the order of magnitude of said predetermined thickness.

* * * * *